United States Patent [19]

Kreinheder et al.

[11] Patent Number: 5,023,623

[45] Date of Patent: Jun. 11, 1991

[54] DUAL MODE ANTENNA APPARATUS HAVING SLOTTED WAVEGUIDE AND BROADBAND ARRAYS

[75] Inventors: Donald E. Kreinheder, Granada Hills; David S. Bell, Canoga Park, both of Calif.

[73] Assignee: Hughes Aircraft Company, Los Angeles, Calif.

[21] Appl. No.: 454,680

[22] Filed: Dec. 21, 1989

[51] Int. Cl.[5] ..... H07Q 21/00

[52] U.S. Cl. ..... 343/725; 343/767; 343/770

[58] Field of Search ..... 343/725, 705, 767, 771

[56] References Cited

U.S. PATENT DOCUMENTS

| | | | |
|---|---|---|---|
| 3,482,248 | 12/1969 | Jones, Jr. | 343/725 |
| 3,523,297 | 8/1970 | Fee | 343/725 |
| 4,141,012 | 2/1979 | Hockham et al. | 343/725 |
| 4,843,403 | 6/1989 | Lalezari et al. | 343/767 |
| 4,853,704 | 8/1989 | Diaz et al. | 343/767 |
| 4,870,426 | 8/1989 | Lamberty et al. | 343/786 |

*Primary Examiner*—Michael C. Wimer
*Assistant Examiner*—Hoanganh Le
*Attorney, Agent, or Firm*—C. D. Brown; R. M. Heald; W. K. Denson-Low

[57] ABSTRACT

A single aperture antenna system disposed to operate simultaneously in active radar and passive broadband modes is disclosed herein. The dual mode antenna apparatus 40 of the present invention includes a waveguide antenna array 50 which generates a first radiation pattern of a first polarization within an antenna aperture A described thereby. The antenna apparatus 40 of the present invention further includes a broadband antenna array 60 coupled to the waveguide antenna array 50 for generating a second radiation pattern of a second polarization within the aperture A.

6 Claims, 5 Drawing Sheets

FIG. 2
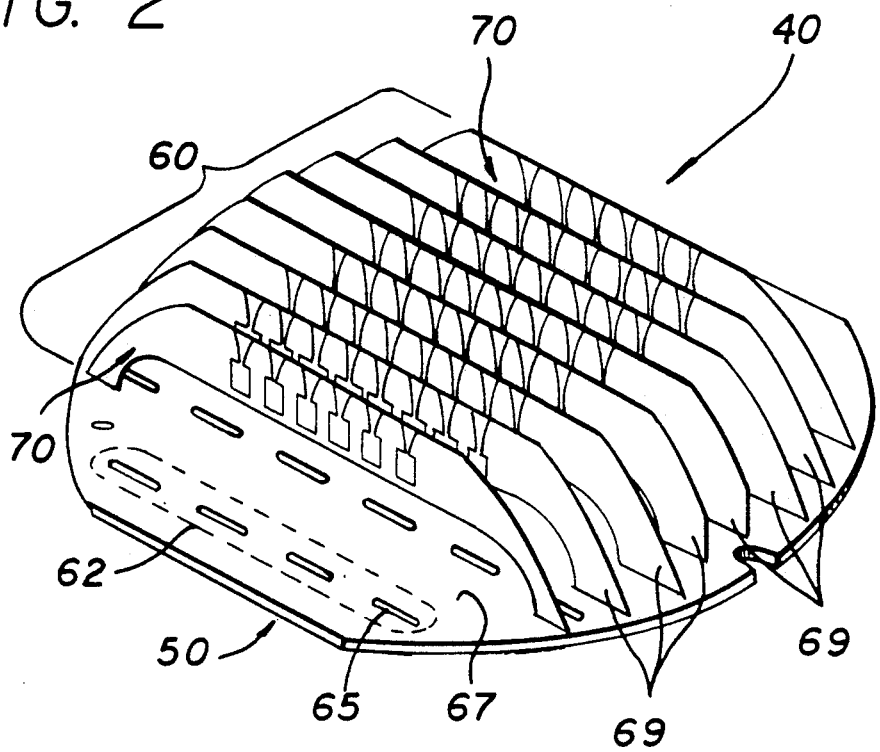
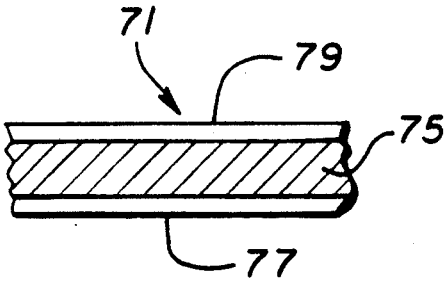
FIG. 3a
FIG. 3b
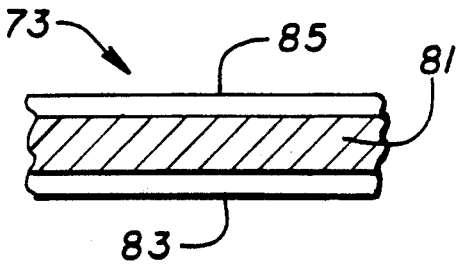

DUAL MODE ANTENNA APPARATUS HAVING SLOTTED WAVEGUIDE AND BROADBAND ARRAYS

BACKGROUND OF THE INVENTION

1. Field of the Invention

The present invention relates to antenna arrays. More specifically, the present invention relates to slotted waveguide and broadband antenna arrays.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

1. Description of the Related Art

As is well known, many conventional missile target detection and tracking systems employ active radar. In such systems the missile radar typically illuminates a target with pulsed radiation of a predetermined frequency and detects the return pulses. Unfortunately, the bandwidth of such active radar systems is typically only approximately three percent of the frequency of the illuminating radiation. The narrow bandwidth of conventional active radar increases susceptibility to jamming. In particular, if an intended target vehicle can discern an approximate frequency range within which the operative frequency of the active radar is included, the target may "jam" the radar by saturating it with large quantities of radiation within this range. These emissions may prevent the active radar from discriminating the return pulses from the radiation transmitted by the jamming vehicle, which may allow the intended target to evade the active radar. Moreover, utilization of active radar discloses the location thereof to the intended target.

A target tracking system complementary to that of active radar is known as broadband anti-radiation homing (ARH). Broadband ARH systems are passive. That is, ARH systems do not illuminate a target with radiation, but instead track the target by receiving radiation emitted thereby. Consequently, an intended target may not frustrate an ARH system simply by emitting radiation as such emissions aid an ARH system in locating a target. Additionally, employment of an ARH system does not reveal the position thereof to the intended target. Nonetheless, an ARH system is generally of utility only to those instances wherein an intended target emits an appreciable quantity of radiation.

As may be evident from the above, a target tracking system incorporating both an active radar and a passive ARH system would be foiled much less easily than one constrained to function in an exclusively active or passive mode. Missiles, however, typically have an extremely limited amount of "forward-looking" surface area available on which to mount antennas associated with either an active radar or broadband ARH system. Consequently, attempts have been made to devise antenna arrays—operative through a single antenna aperture—for both active and passive target tracking.

A first approach to such a single aperture system entails deploying an array of broad frequency bandwidth radiating elements together with a broadband feed network. However, these arrays have limited efficiency, and thus low gain, due to losses in the broadband circuits included therein. Thus, when operative in the active radar mode these circuits typically lack the high efficiency and power capabilities of conventional active radar. In a second unitary aperture approach, active target tracking and passive target identification are attempted to be effected by suspending broadband dipole elements above an active radar array. Unfortunately, such an approach is unsuitable for broadband passive target tracking due to the small number of dipole elements which may be included within the antenna aperture.

Hence, a need in the art exists for an antenna system operative through a single antenna aperture which is capable of functioning simultaneously in active radar and passive broadband modes.

SUMMARY OF THE INVENTION

The need in the art for a single aperture antenna system simultaneously operative in both active radar and passive broadband modes is addressed by the dual mode antenna apparatus of the present invention. The dual mode antenna apparatus of the present invention includes a waveguide antenna array which generates a first radiation pattern of a first polarization through an antenna aperture described thereby. The present invention further includes a broadband antenna array coupled to the waveguide antenna array for generating a second radiation pattern of a second polarization through the aperture.

BRIEF DESCRIPTION OF THE DRAWINGS

FIG. 2 is a magnified view of the dual mode antenna apparatus of the present invention.

FIG. 3*a* is a cross sectional view of a first copper clad dielectric wafer.

FIG. 3*b* is a cross sectional view of a second copper clad dielectric wafer.

DETAILED DESCRIPTION OF THE INVENTION

Figure 1:
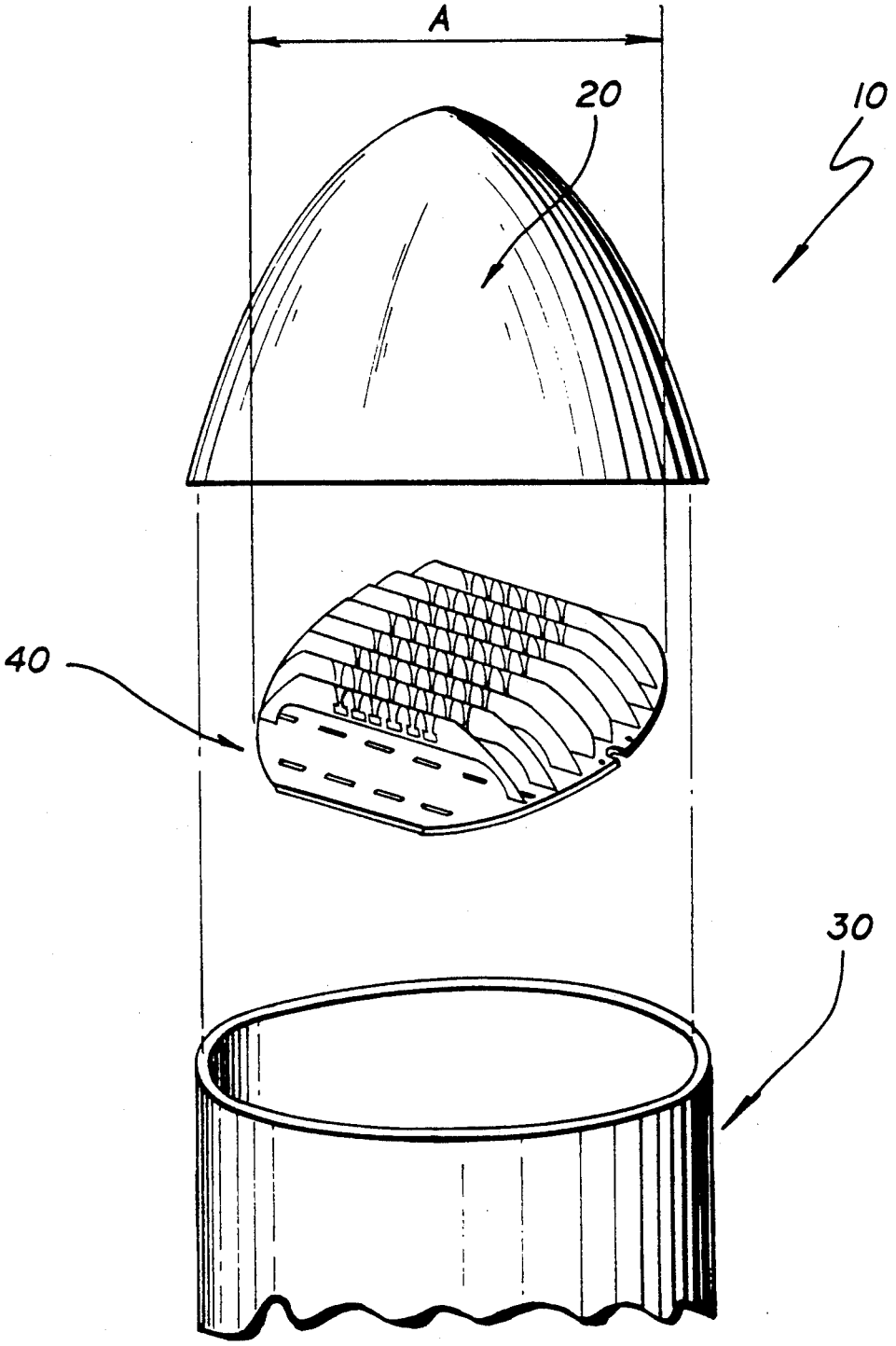
FIG. 1 is an illustrative representation of a partially disassembled missile.

FIG. 1 is an illustrative representation of a partially disassembled missile 10. The missile 10 includes a radome 20, a housing 30, and the dual mode antenna apparatus 40 of the present invention. The antenna apparatus 40 is typically mounted on a gimbal (not shown), and describes an aperture A. As is discussed below, the aperture A is utilized by the apparatus 40 to simultaneously perform active radar and broadband anti-radiation homing (ARH) target tracking. When deployed in the missile 10, the broadband ARH mode of the apparatus 40 of the present invention is operative from approximately 6 to 18 GHz. Consequently, the radome 20 is realized from a sandwiched construction of reinforced Teflon skins and polymide glass honeycomb adapted to be substantially electromagnetically transmissive from 6 to 18 GHz.

FIG. 2 is a magnified view of the dual mode antenna apparatus 40 of the present invention. The antenna apparatus 40 includes a slotted waveguide array antenna 50 and a broadband ARH antenna array 60. The slotted waveguide array 50 includes a plurality of rows 62 of rectangular slots 65 defined by an electrically conductive ground plane 67. The slots 65 guide electromagnetic energy in the form of radar pulses which are transmitted and received through the aperture A. The transmitted radar pulses are generated, and received pulses are collected, within a waveguide feed network (not shown) coupled to the array 50.

As shown in FIG. 2, individual eight-notch linear array elements 69 and six-notch linear array elements 70 included within the ARH array 60 are positioned between the rows of rectangular slots and are coupled to the ground plane 67. In this manner the ground plane 67 provides both an electrical ground and a mechanical mounting platform for the array 60. The ARH array 60 is operative in a receive mode, and generates a radiation pattern such that the aperture A is utilized for detecting radiation emitted by a target under surveillance.

In the embodiment of FIG. 2, each of the array elements 69, 70 is formed by conventionally bonding a pair of substantially identically shaped dielectric wafers initially clad with copper. One acceptable choice of dielectric material for these wafers is fiberglas reinforced Teflon. Although the following discussion describes fabrication of the eight-notch linear array elements 69, the process is substantially identical for the six-notch array elements 70. FIGS. 3*a*, 3*b* show cross sectional views of first and second wafers 71, 73, respectively. As shown in FIG. 3*a*, the first wafer 71 has a first dielectric layer 75 sandwiched between first and second copper layers 77, 79. Inspection of FIG. 3*b* reveals that the second wafer 73 has a second dielectric layer 81 sandwiched between third and fourth copper layers 83, 85. The first and second wafers 71 and 73 are processed as described immediately below, and then are subsequently bonded to form each of the linear array elements 69.

Figure 4A:
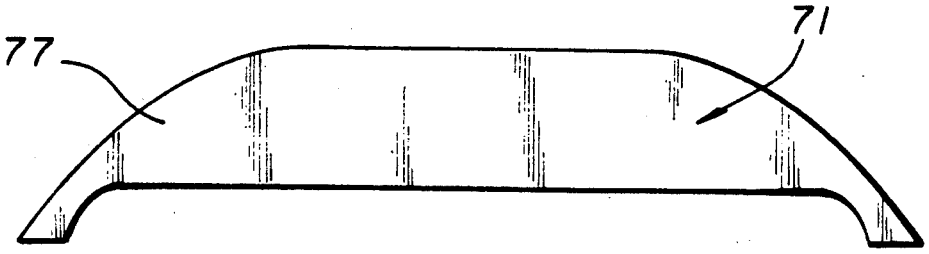
FIG. 4*a* shows a front view of the first copper clad dielectric wafer.
Figure 4B:
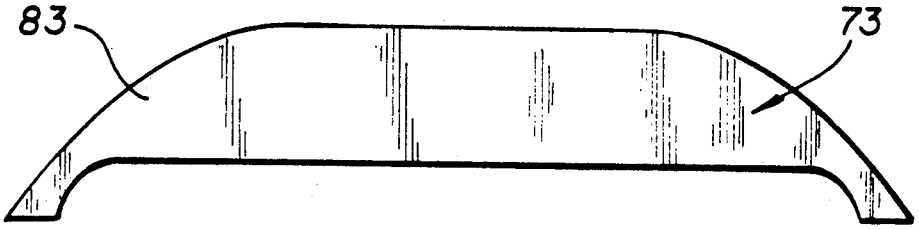
FIG. 4*b* shows a front view of the second copper clad dielectric wafer.
Figure 5A:
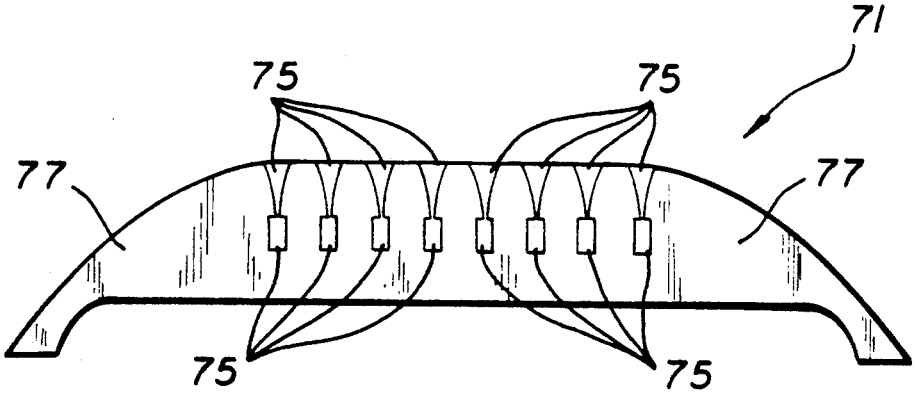
FIG. 5*a* shows a front view of the first dielectric wafer wherein the first copper layer has been partially etched to selectively expose the first dielectric layer.
Figure 5B:
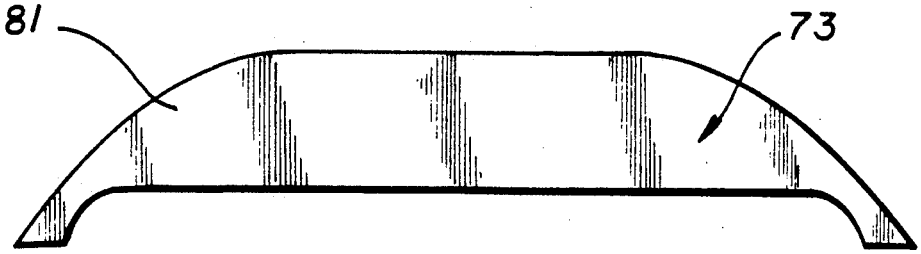
FIG. 5*b* shows a front view of the second dielectric wafer wherein the third copper layer has been completely removed, thereby exposing to view the second dielectric layer.
Figure 6A:
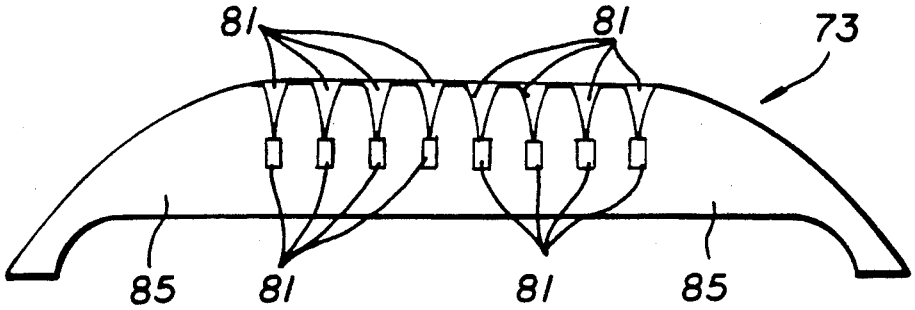
FIG. 6*a* shows a back view of the second dielectric wafer wherein the fourth copper layer has been partially etched to selectively expose the second dielectric layer.

As a first processing step the first and second wafers 71, 73 are cut into the shapes shown in FIGS. 4*a*, 4*b*. As FIGS. 4*a*, 4*b* show front views of the wafers 71, 73, only the first and third copper layers 77, 83 are visible. Next, the first copper layer 77 is partially etched from the first wafer 71 to selectively expose the first dielectric layer 75 as shown in FIG. 5*a*. As shown in FIG. 5*b*, the third copper layer 83 is then removed from the second wafer 73 thereby exposing to view the second dielectric layer 81. As shown in the back view of FIG. 6*a*, the fourth copper layer 85 is then partially etched from the second wafer 73 in a substantially identical pattern to selectively expose the second dielectric layer 81. Next, the second copper layer 79 is selectively etched from the first wafer 71 to form the feed network pattern shown in the back view of FIG. 6*b*.

Figure 6B:
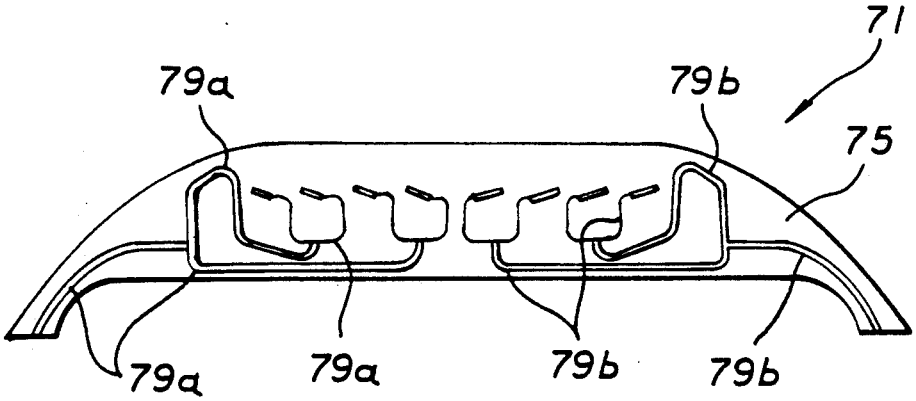
FIG. 6*b* shows a back view of the first dielectric wafer wherein the second copper layer has been selectively etched to form a feed network pattern.
Figure 7:
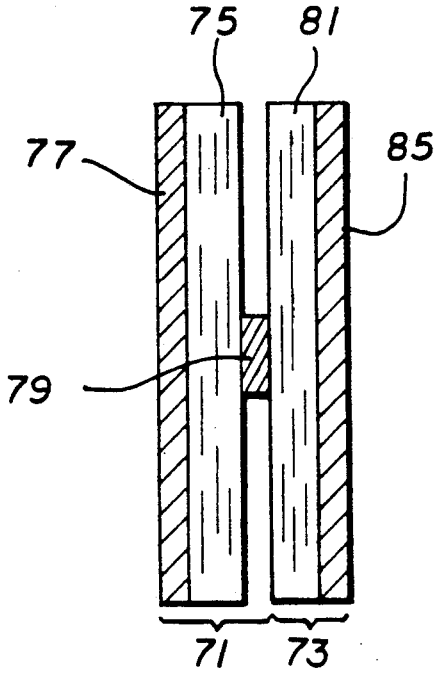
FIG. 7 shows a lateral cross sectional view of a broadband array element formed by mating the first and second dielectric wafers.

Following the processing of the first and second wafers 71, 73 as described above, the surface of the first wafer 71 depicted in FIG. 6*b* is bonded by conventional means to the surface of the second wafer 73 shown in FIG. 5*b*—thereby forming an array element 69. FIG. 7 shows a lateral cross sectional view along the dashed line C (see FIG. 6*b*) of the array element 69 formed from the first and second wafers 71, 73. The array element 69 of FIG. 7 is typically approximately 0.03 inches thick. As shown in FIG. 7, the remaining portion of the the second copper layer 79 is now sandwiched between the first and second dielectric layers 75, 81. Thus, the cross sectional view of FIG. 7 shows the manner in which the wafers 71, 73 may be combined to form a stripline antenna feed network within an array element 69. In particular, the remaining portions of the second copper layer 79 serve as the conductor and the intact portions of the first and fourth copper layers 77, 85 provide ground planes for the stripline network.

Figure 8:
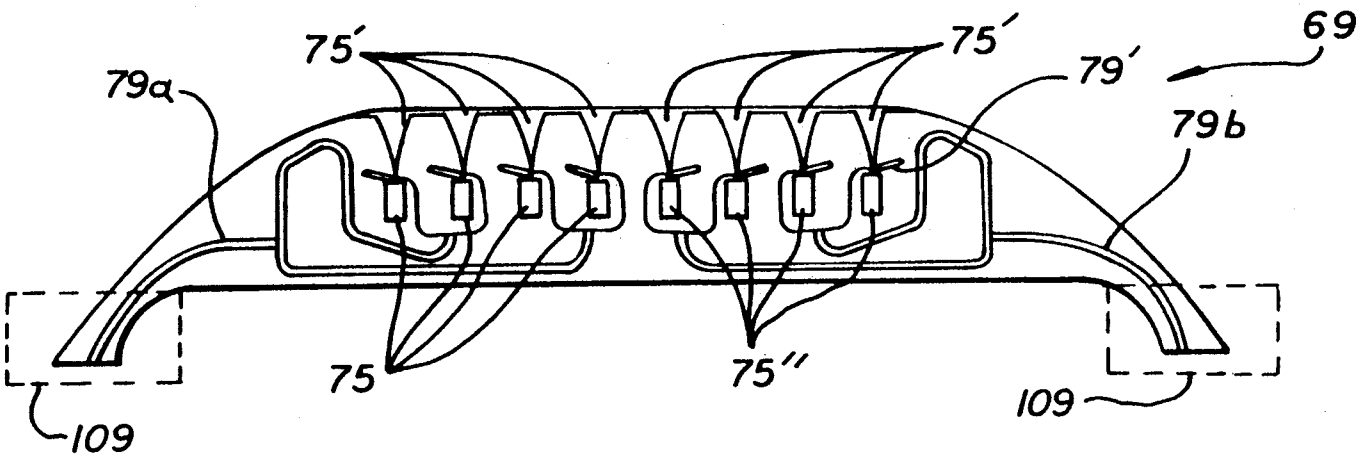
FIG. 8 is a partial see-through view of the broadband array element of FIG. 7.

FIG. 8 is a partial see-through view of the array element 69 formed by mating the wafers 71, 73 as described above. The view of FIG. 8 is through the surface of the element 69 defined by the first copper layer 77, wherein the layer 77 is taken to be partially transparent to allow viewing of first and second stripline feed networks 79*a*, 79*b* formed by the remaining portion of the second copper layer 79. The substantially triangular exposed areas 75' of the first dielectric layer 75 form eight notch radiating elements. The notch elements 75' are fed by the stripline feed networks 79*a*, 79*b*. The notch elements 75' are electromagnetically coupled to the networks 79*a*, 79*b* by open-circuited stripline matching elements (baluns) 79' and substantially rectangular exposed areas 75'' of the first dielectric layer 75. Each matching element 79' is formed from an intact portion of the second copper layer 79. The composite reactance of the open-circuited stripline matching element 79' and rectangular area 75'' is designed to remain substantially zero over changes in frequency so as to ensure a suitable impedance match between the feed networks 79*a*, 79*b* and notch elements 75'.

Figure 9:
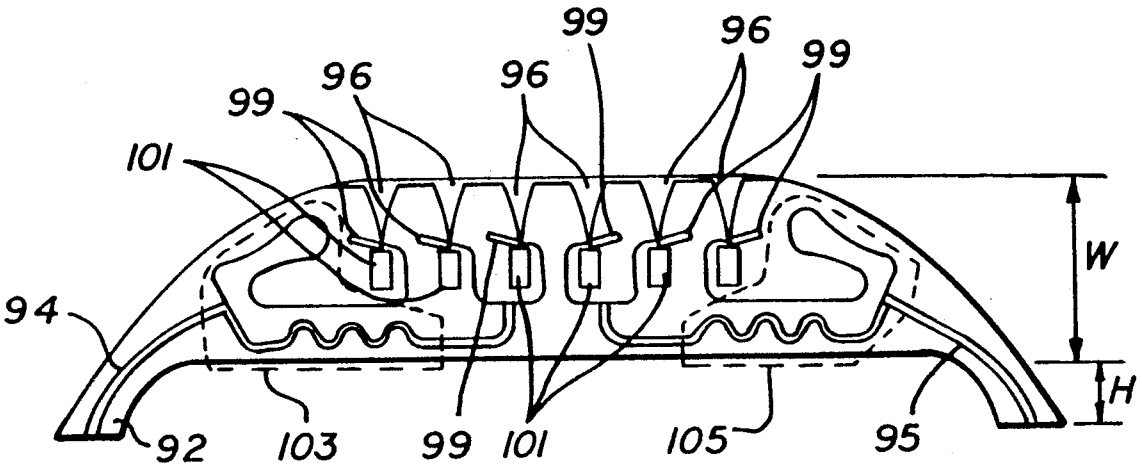
FIG. 9 is a partial see-through view of a six-notch broadband array element element.

FIG. 9 is a partial see-through view of one of the six-notch array elements 70. Each of the elements 70 is formed by the process described above with reference to the eight-notch elements 69. The view of FIG. 9 is through the surface of the element 70 defined by an outer copper layer 92, wherein the layer 92 is taken to be partially transparent to allow viewing of third and fourth stripline feed networks 94, 95. Again, the array element 70 includes six dielectric notch radiating elements 96. Each radiating element 96 is electromagnetically coupled to either the third network 94 or the fourth network 95 by an open-circuited matching element (balun) 99 and a substantially rectangular dielectric area 101. Again, the composite reactance of the open-circuited stripline element 99 and rectangular area 101 is designed to remain substantially zero over changes in frequency so as to ensure a suitable impedance match between the feed networks 94, 95 and notch elements 96.

As shown in FIG. 9, the feed networks 94, 95 include first and second line length compensation networks 103, 105 for adjusting the phase of signals carried by the feed networks 94, 95. The feed networks 94, 95 are designed such that the phase of signals driving the six notch radiating elements 96 may be matched with the phase of signals driving the innermost six notch radiating elements 75' of the eight-notch array element 69 (see FIG. 8). This allows the first, second, third and fourth feed networks 79*a*, 79*b*, 94, 95 to be selectively actuated by a beam forming network (not shown) to project radiation patterns through the antenna aperture A (FIG. 1).

As shown in FIG. 2, the eight-notch and six-notch linear array elements 69, 70 included within the ARH array 60 are positioned between the rows 62 of rectangular slots 65 and are coupled to the ground plane 67. This positioning prevents electromagnetic energy emitted by the rectangular waveguide slots 65 from being reflected back therein. Moreover, by elevating the ARH array 60 above the ground plane 67 by a distance of approximately one-half of the operative wavelength of the slotted waveguide array 50, undesirable electromagnetic interference between the ARH array 60 and waveguide array 50 is substantially eliminated. Such interference may also be minimized by raising the ARH array 60 half-wavelength multiples above the ground plane 67, but such an arrangement is not suitable for inclusion within the missile 10 given the confining geometry of the radome 20. Additionally, electromagnetic interference between the waveguide array 50 and broadband ARH array is further reduced by adjusting the relative polarization of radiation originating within each array by 90 degrees (cross polarization). It is therefore a feature of the present invention that the slotted waveguide array 50 and broadband ARH array 60 may be operated in tandem through a common aperture A with negligible electromagnetic interaction.

FIG. 2 also reveals the ARH array 60 to have an even number of linear array elements 69, 70. Moreover, each of the linear array elements 69, 70 includes an even number of radiative notches. This arrangement facilitates dividing the array 60 into four quadrants having equal numbers of radiative elements. Certain tracking algorithms, such as monopulse ARH tracking, operate by processing the energy received by radiative elements within individual quadrants of the ARH array 60. Hence, such algorithms are easily implemented using the ARH array 60 included within the antenna apparatus 40 of the present invention. The ARH array 60 may be designed with an odd number of linear array elements 69, 70 by providing a separate antenna feed network to drive the center linear array element.

As shown in FIG. 8, each of the linear array elements 69, 70 includes a pair of support legs 109 for mechanically coupling the elements 69, 70 to the ground plane 67. The legs 109 also allow the stripline feed networks 79*a*, 79*b* to be connected at the ground plane 67 to ancillary processing circuitry (not shown). In an alternative embodiment of the antenna apparatus 40 of the present invention, the gain of the slotted array 50 may be increased by substituting a molded contiguous piece, or individually tailored sections, of a low density dielectric foam such as Eccofoam EPH for the the legs 109. The stripline feed networks 79*a*, 79*b* may be extended to the ground plane 67 with small diameter coaxial cable (typically approximately 0.034 in.). The coaxial cable is coupled to the stripline networks with a stripline to coax transition.

The principal factors determining the effect of the broadband ARH array 60 on the gain of the slotted waveguide array 50 may be summarized as: (1) the distance H between the lower edge of the array elements 69, 70 and the ground plane 67 (see FIG. 9), (2) the width W of the array elements 69, 70 (see FIG. 9), (3) the manner in which the ARH array 60 is coupled to, and elevated above, the ground plane 67, and, (4) the thickness of each of the array elements 69, 70 (see cross sectional view of FIG. 7). These factors may be manipulated such that the dual mode antenna apparatus 40 of the present invention may be utilized in a variety of applications.

Thus the present invention has been described with reference to a particular embodiment in connection with a particular application. Those having ordinary skill in the art and access to the teachings of the present invention will recognize additional modifications and applications within the scope thereof. For example, the substantially triangular radiative elements may be realized in other shapes without departing from the scope of the present invention. In addition, the topology of the matching networks accompanying each radiative element may be modified to minimize signal loss at particular operative frequencies. Similarly, the invention is not limited to the vertical displacement of the broadband array relative to the slotted waveguide array disclosed herein. With access to the teachings of the present invention those skilled in the art may be aware of suitably non-interfering vertical displacements other than approximately one-half of the operative wavelength of the slotted waveguide array.

It is therefore contemplated by the appended claims to cover any and all such modifications.

Accordingly, What is claimed is:

1. A dual mode antenna apparatus, said apparatus describing an antenna aperture, comprising:

waveguide antenna array means for generating a first radiation pattern of a first polarization through said aperture, said waveguide antenna array means including a slotted waveguide antenna having a plurality of rows of waveguide slots opening on a ground plane, each of said slots being rectangularly shaped and arranged lengthwise in said rows; and broadband antenna array means coupled to said waveguide antenna array means for generating a second radiation pattern of a second polarization through said aperture, said broadband antenna array means including a plurality of linear notch element arrays, each of said notch element arrays being positioned substantially parallel with said rows of waveguide slots.

2. The antenna apparatus of claim 1 wherein each of said notch element arrays includes:

a pair of electrically conductive parallel planar surfaces sandwiching a dielectric layer in which a conductive feed network is embedded, said parallel conductive surfaces being coupled to said ground plane and extending over said ground plane with said parallel conductive surfaces oriented substantially perpendicular to said ground plane;

a plurality of substantially triangular notches etched into the portion of said parallel conductive planar surfaces extending over said ground plane, each of said notches being electromagnetically coupled to said feed network.

3. The antenna apparatus of claim 2 wherein the electromagnetic energy of said first radiation pattern is of a first wavelength and the portion of each of said parallel conductive surfaces extending over said ground plane is positioned a distance of approximately one half of said first wavelength therefrom.

4. The antenna apparatus of claim 3 wherein each of said element arrays includes an even number of notches, and wherein a plurality of said notches are driven by a first signal through the conductive feed network coupled thereto and the remainder of said notches are driven by the inverse of said first signal through the feed network coupled thereto.

5. The antenna apparatus of claim 4 wherein each notch array within a first set of said notch arrays includes a first number of elements and wherein each notch array within a second set of said notch arrays includes a second number of elements.

6. The antenna apparatus of claim 5, wherein the conductive feed network within each of said second set of notch arrays includes a line length compensation network.

* * * * *